United States Patent [19]

Stokes

[11] Patent Number: 4,471,514

[45] **Date of Patent: * Sep. 18, 1984**

[54] APPARATUS FOR IMPARTING VISUAL SURFACE EFFECTS TO RELATIVELY MOVING MATERIALS

[75] Inventor: Jimmy L. Stokes, Moore, S.C.

[73] Assignee: Milliken Research Corporation, Spartanburg, S.C.

[ * ] Notice: The portion of the term of this patent subsequent to Jul. 19, 1900 has been disclaimed.

[21] Appl. No.: 282,330

[22] Filed: Jul. 10, 1981

[51] Int. Cl.[3] ..... D06C 23/00

[52] U.S. Cl. ..... 26/2 R; 26/69 R; 26/69 A; 28/160; 28/163

[58] Field of Search ..... 26/2 R, 3, 69 R, 69 A; 28/160, 163

[56] References Cited

U.S. PATENT DOCUMENTS

| | | | |
|---|---|---|---|
| 2,110,118 | 3/1938 | Robertson et al. . | |
| 3,256,581 | 6/1966 | Thal et al. . | |
| 3,443,878 | 5/1969 | Weber et al. . | |
| 3,721,517 | 3/1973 | Osthoff | 26/3 X |
| 3,729,784 | 5/1973 | Mazzone et al. . | |
| 3,842,468 | 10/1974 | Harrison . | |
| 4,323,760 | 4/1982 | Greenway et al. | 26/2 R X |
| 4,364,156 | 12/1982 | Greenway et al. . | |
| 4,393,562 | 7/1983 | Stokes | 26/2 R |

FOREIGN PATENT DOCUMENTS

| | | | |
|---|---|---|---|
| 275696 | 8/1927 | United Kingdom | 26/3 |
| 978452 | 12/1964 | United Kingdom . | |
| 1063252 | 3/1967 | United Kingdom . | |
| 1172289 | 11/1969 | United Kingdom . | |
| 2065035 | 6/1981 | United Kingdom | 26/2 R |
| 2098249 | 11/1982 | United Kingdom . | |

*Primary Examiner*—Robert Mackey

*Attorney, Agent, or Firm*—George M. Fisher; H. William Petry

[57] ABSTRACT

Apparatus for imparting visual surface effects to a relatively moving substrate by application of discrete streams of heated pressurized fluid to surface areas of the substrate. The apparatus includes an elongate manifold assembly comprising two fluid receiving compartments, each extending across the path of said substrate. Fluid from the first compartment passes into the second compartment, which is comprised of a series of chambers, each associated with a throttling gap. The fluid is uniformly mixed within this second compartment, and may then be directed onto the substrate as a thin, continuous stream extending the length of the manifold. By use of blocking streams of relatively cool fluid, smaller streams or groups of streams extending along selected portions of the manifold may be formed.

3 Claims, 8 Drawing Figures

FIG.-5-
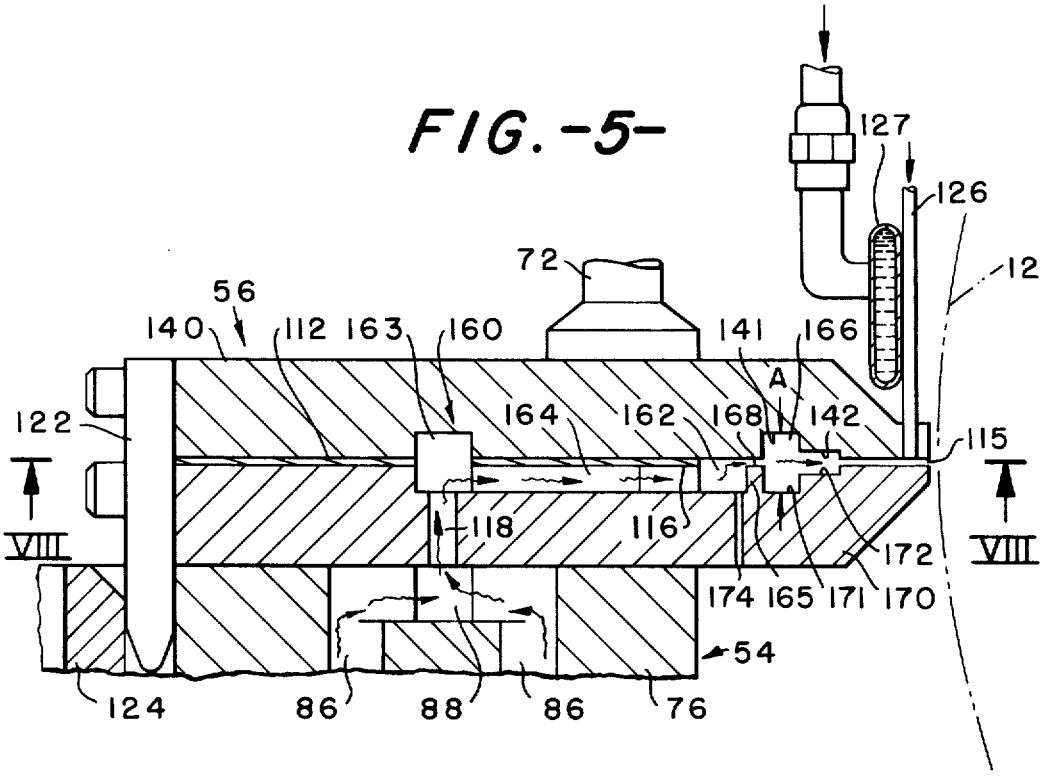
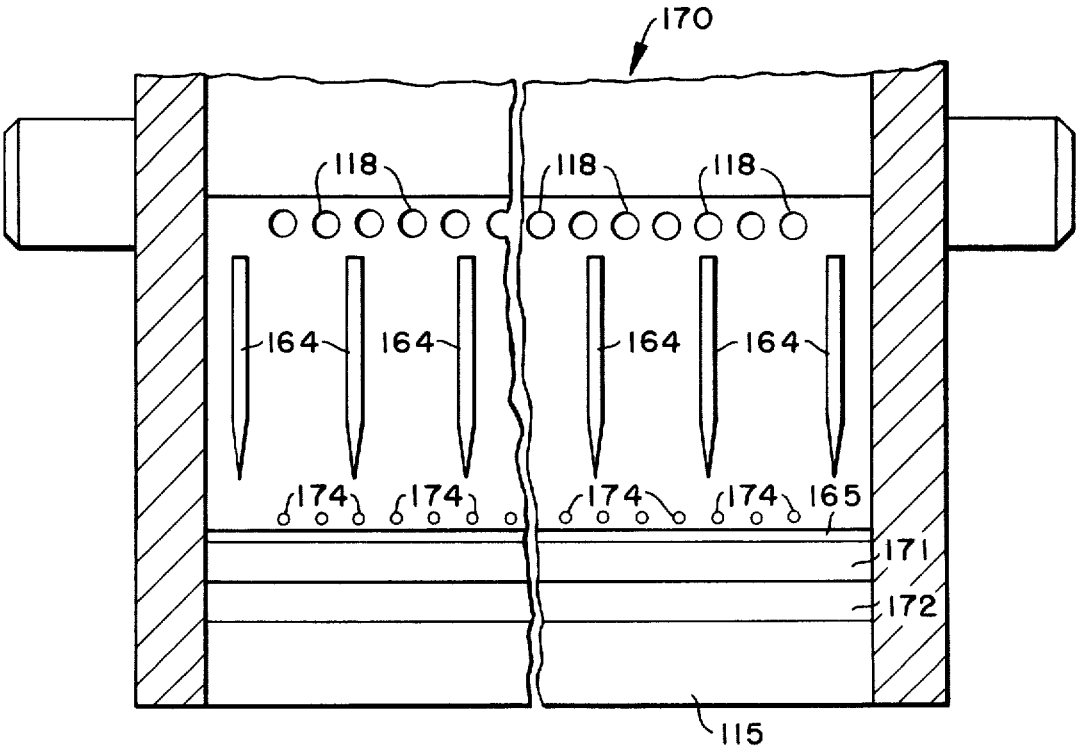
FIG.-6-

APPARATUS FOR IMPARTING VISUAL SURFACE EFFECTS TO RELATIVELY MOVING MATERIALS

This invention relates to improved apparatus for pressurized heated fluid stream treatment of relatively moving materials to provide visual surface effects therein, and, in a specific embodiment, to an improved apparatus using a novel continuous slit manifold for precise selective application of discrete, high temperature, pressurized streams of air or gaseous materials against the surface of a thermally modifiable, relatively moving substrate material, such as a textile fabric containing thermoplastic yarn or fiber components, to thermally modify the same and impart a visual change and/or pattern effect therein.

BACKGROUND OF THE INVENTION

Various apparatus have been proposed for directing heated pressurized fluid streams, such as air or steam, into the surface of moving textile fabrics to alter the location of or modify the thermal properties of fibers or yarns therein and provide a pattern or visual surface change in such fabrics. Examples of such prior art equipment and methods of application of the pressurized fluid streams to a relatively moving material are disclosed in the following U.S. Pat. Nos.: 2,110,118, 2,241,222, 2,563,259, 3,010,179, 3,256,581, 3,403,862, 3,434,188, 3,585,098, 3,613,186, 3,729,784, 3,774,272.

It is believed that such prior art treatment devices as described in the aforementioned patents, because of the nature of the equipment disclosed, are generally not capable of producing precise, intricate, or well defined patterns of wide variety in the fabrics, but generally can only produce limited or relatively grossly defined patterns, or surface modifications of a random, non-defined nature in the materials. In utilizing high temperature pressurized streams of fluid, such as air, to impart visual surface patterns to textile fabrics containing thermoplastic materials by thermal modification of the same, it can be appreciated that highly precise control of stream pressure, temperature, and velocity is required in all of the individual heated streams striking the fabric to obtain uniformity and preciseness in the resultant pattern formed in the fabric. Where a single continuous stream of substantial width is used, uniformity along the width of the stream is also essential. In addition, there are ever present difficulties in regulating the flow of high temperature fluid streams by use of conventional valving systems to selectively cut the stream flow on or off in accordance with pattern control information.

More recently, apparatus has been developed for more precisely and accurately controlling and directing high temperature streams of pressurized fluid, such as air, against the surface of a relatively moving substrate material, such as a textile fabric containing thermoplastic yarns, to impart intricate patterns and surface changes thereto. Such apparatus, an example of which may be found in commonly assigned U.S. patent application Ser. No. 103,329, filed Dec. 14, 1979, includes an elongate pressurized heated air distributing manifold having a narrow elongate air discharge slot extending across the path of fabric movement in close proximity to the fabric surface. Located within the manifold is a shim plate having a notched edge which resides in the discharge slot to form parallel spaced discharge channels through which the heated pressurized air passes in narrow, precisely defined streams to impinge upon the adjacent surface of the fabric. Flow of the individual heated air streams from the channels is controlled by the use of pressurized cool air which is directed by individual cool air supply tubes communicating with each channel to direct cool air into each discharge channel at a generally right angle to its discharge axis to block the passage of heated air therethrough. Each cool air tube is provided with an individual valve and the valves are selectively cut on and off in response to signal information from a pattern source, such as a computer program, to allow the heated air streams to strike the moving fabric in selected areas and impart a pattern thereto comprised of lines or line segments running in the direction of substrate travel, by thermal modification of the yarns. To maintain more uniform temperature in the individual heated air streams along the full length of the distributing manifold, pressurized air is supplied to the distributing manifold through a bank of individual electric heaters which communicate with the manifold at uniformly spaced locations along its length and are regulated to introduce heated air at the desired temperature along the full length of the manifold.

Although such apparatus as described above provides for highly precise and intricate hot air patterning of substrate materials, the patterns imparted to the substrate are somewhat limited by the configuration of the particular shim plate used. An apparatus using a notched shim plate can only produce a pattern in which the lines or line segments of the pattern correspond to one or more notched locations along the shim plate. For example, if the shim plate has notches 0.04 inch wide on center lines spaced at 0.2 inch intervals, a pattern in which the lines or line segments are spaced across the substrate at 0.2 inch intervals or integral multiples thereof can be produced. But a pattern requiring line segments spaced at, for example, 0.1 or 0.3 inch intervals cannot be produced without replacement of the notched shim plate. If a pattern comprising solid areas, rather than lines or line segments running parallel to the substrate path is desired, the shim plate does not allow pressurized fluid to strike the substrate from any location along the manifold discharge slot which does not correspond to a notch location. This limitation also prevents use of any pattern requiring solid horizontal lines, i.e., lines running perpendicular to the direction of substrate travel. These restrictions severely limit the number and types of patterns which may be used.

Previously referenced U.S. patent application Ser. No. 103,329 discloses a "continuous slit" manifold in which no shim plate is used. In this design, the pressurized cool air used as a blocking means is used to define the discharge channels as well. The heated, pressurized air may be directed onto the substrate from along the entire width of the discharge slot extending across the substrate or from any portion or portions thereof, the full width stream of air being interrupted or blocked only by the flow of pressurized cool air from cool air tubes similar to those used in the shim-type manifold described above. However, use of the continuous slit manifold as described in the above-referenced application sometimes results in unevenly patterned substrates. It has been discovered that the overall design of this continuous slit manifold causes non-uniformities in the flow of heated air from the discharge slot, which in turn, causes non-uniform treatment within the treated areas of the substrate, particularly where the patterns comprise relatively large areas contacted by the heated air, or where the entire width of the substrate, or a substantial portion thereof, is treated.

It is, accordingly, an object of the invention to provide a distributing manifold for heated, pressurized fluids which can direct a continuous stream or blade of heated fluid extending across the width of a moving substrate which results in uniform surface treatment of said substrate.

It is a further object of this invention to provide a distributing manifold for heated, pressurized fluid in which the stream or blade of fluid is substantially uniform with respect to fluid temperature, pressure, and velocity across the full width of said manifold.

It is yet another object of this invention to provide a distributing manifold for heated, pressurized fluids which facilitates economical construction, rapid pattern changes, and routine maintenance.

Other objects and advantages of this invention will become apparent following an understanding of the description and discussion of the invention as presented hereinbelow.

BRIEF DESCRIPTION OF THE INVENTION

Briefly, the present invention comprises an improved fluid distributing manifold means for directing a stream of pressurized heated fluid, such as hot air, into the surface of a relatively moving substrate, in particular substrate materials containing thermoplastic components, to impart a precise pattern or surface change thereto. The manifold means comprises a pair of elongate manifold housings coupled together and defining respective first and second pressurized fluid-receiving compartments. Heated fluid is supplied to the first elongate manifold housing compartment through multiple inlets, uniformly spaced along its length, and the heated fluid passes through the first housing compartment in a particularly directed path generally perpendicular to its length to facilitate uniform distribution and temperature of the fluid along the length of the housing. The heated fluid from the first housing passes into the second elongate housing compartment which is provided with mixing chambers to further mix the fluid and assure its uniformity with respect to temperature, pressure and velocity. Also included in said second housing compartment is an outlet channel extending the length of the housing compartment and oriented to direct streams of heated fluid from within said second housing compartment generally at a right angle into the surface of the substrate material. The manifold housings are constructed and arranged so that the flow path of fluid through the first housing is generally at a right angle to the discharge axes of the fluid stream outlets of the second manifold housing. Means for directing jets of relatively cool fluid into the path of said heated fluid are provided as a part of said second housing compartment to allow selective treatment of said substrate surface. Bleed ducts are also provided in said second manifold housing to minimize temperature differential within said manifold means.

BRIEF DESCRIPTION OF THE DRAWINGS

Objects and details of the invention will be better understood from the following detailed description of preferred embodiments thereof, when taken together with the accompanying drawings, in which:

FIG. 5 is an enlarged broken away sectional view of the fluid stream distributing manifold housing portion of the manifold assembly as illustrated in FIG. 2;

FIG. 6 is an enlarged, schematicized plan view of end portions of the fluid stream distributing manifold housing looking in the direction of the arrows VI—VI of FIG. 2;

DETAILED DESCRIPTION OF PREFERRED EMBODIMENTS

Figure 1:
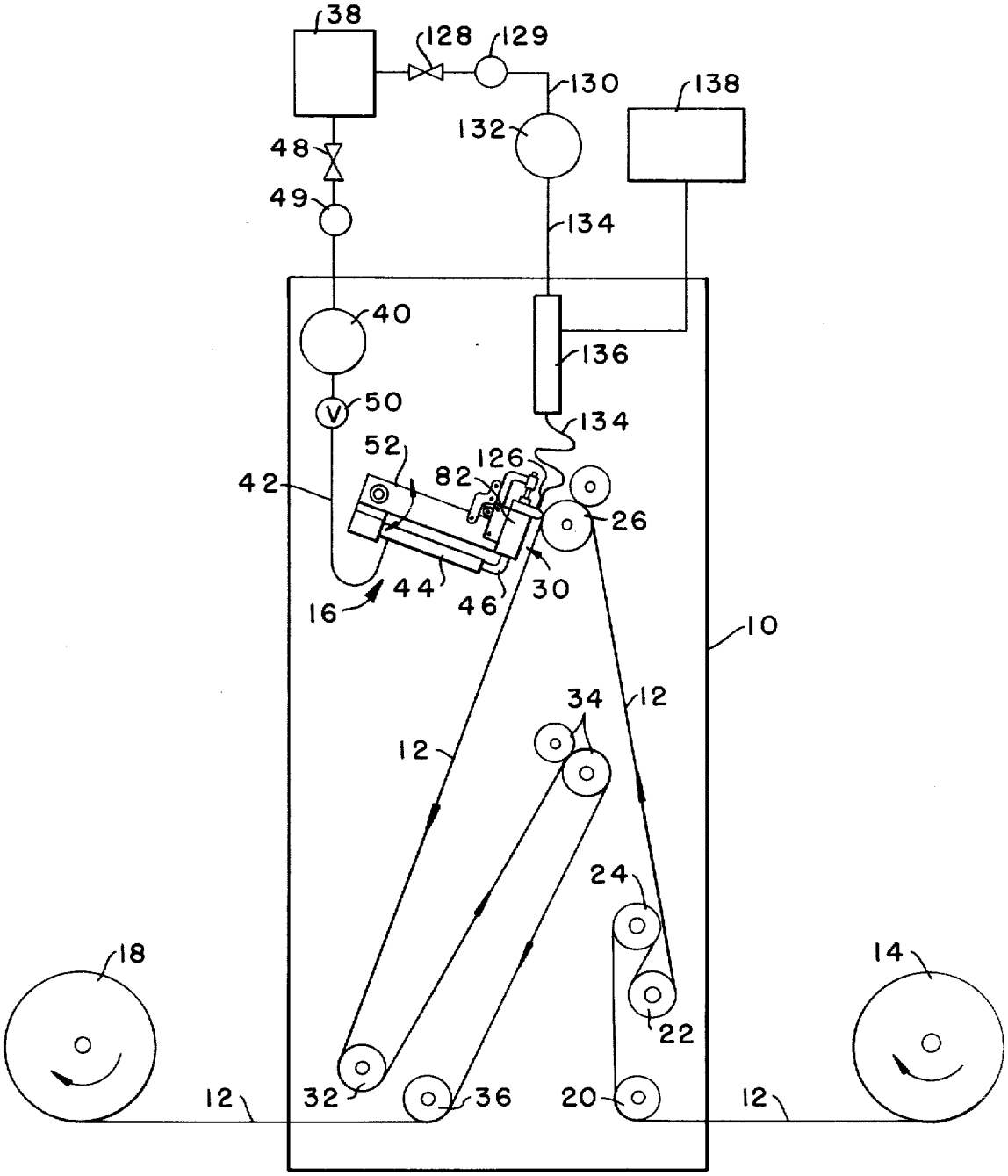
FIG. 1 is a schematic side elevation view of apparatus for pressurized heated fluid stream treatment of a moving substrate material to impart a surface pattern or change in the surface appearance thereof, and incorporating novel features of the present invention.

Referring more specifically to the drawings, FIG. 1 shows, diagrammatically, an overall side elevation view of apparatus for pressurized heated fluid stream treatment of a moving substrate material to impart a pattern or visual change thereto. As seen, the apparatus includes a main support frame including end frame support members, one of which 10 is illustrated in FIG. 1. Suitably rotatably mounted on the end support members of the frame are a plurality of substrate guide rolls which direct an indefinite length substrate material, such as a textile fabric 12, from a fabric supply roll 14, past a pressurized heated fluid treating unit, generally indicated at 16. After treatment, the fabric is collected in continuous manner on a take-up roll 18. As shown, fabric 12 from supply roll 14 passes over an idler roll 20 and is fed by a pair of driven rolls 22, 24 to a main driven fabric support roll 26 to pass the surface of the fabric closely adjacent the heated fluid discharge outlets of an elongate fluid distributing manifold assembly 30 of treating unit 16. The treated fabric 12 thereafter passes over a series of driven guide rolls 32, 34 and an idler roll 36 to take up roll 18 for collection. For purposes of discussion, the following discussion will assume air is the preferred fluid. It should be understood, however, that other fluids may be used.

As illustrated in FIG. 1, fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of manifold assembly 30 and supply heated pressurized air thereto through short, individual air supply lines, indicated at 46, which communicate with assembly 30 uniformly along its full length. Air supply to the fluid distributing manifold assembly is controlled by a master control valve 48, pressure regulator valve 49, and individual precision control valves, such as needle valves 50, located in each heater air supply line 42. The heaters are controlled in suitable manner, as by temperature sensing means located in the outlet lines 46 of each heater, with regulation of air flow and electrical power to each of the heaters to maintain the heated fluid at a uniform temperature and pressure as it passes into the manifold assembly along its full length. Typically, for patterning textile fabrics, such as pile fabrics containing thermoplastic pile yarns, the heaters are employed to heat air exiting the heaters and entering the manifold assembly to a uniform temperature of about 700° F.–800° F.

The heated fluid distributing manifold assembly 30 is disposed across the full width of the path of movement of the fabric and closely adjacent the surface thereof to be treated. Typical surface spacing is 0.020 to 0.030 inch. Although the length of the manifold assembly may vary, typically in the treatment of textile fabric materials the length of the manifold assembly may be 76 inches or more to accommodate fabrics of up to about 72 inches in width.

Figure 7:
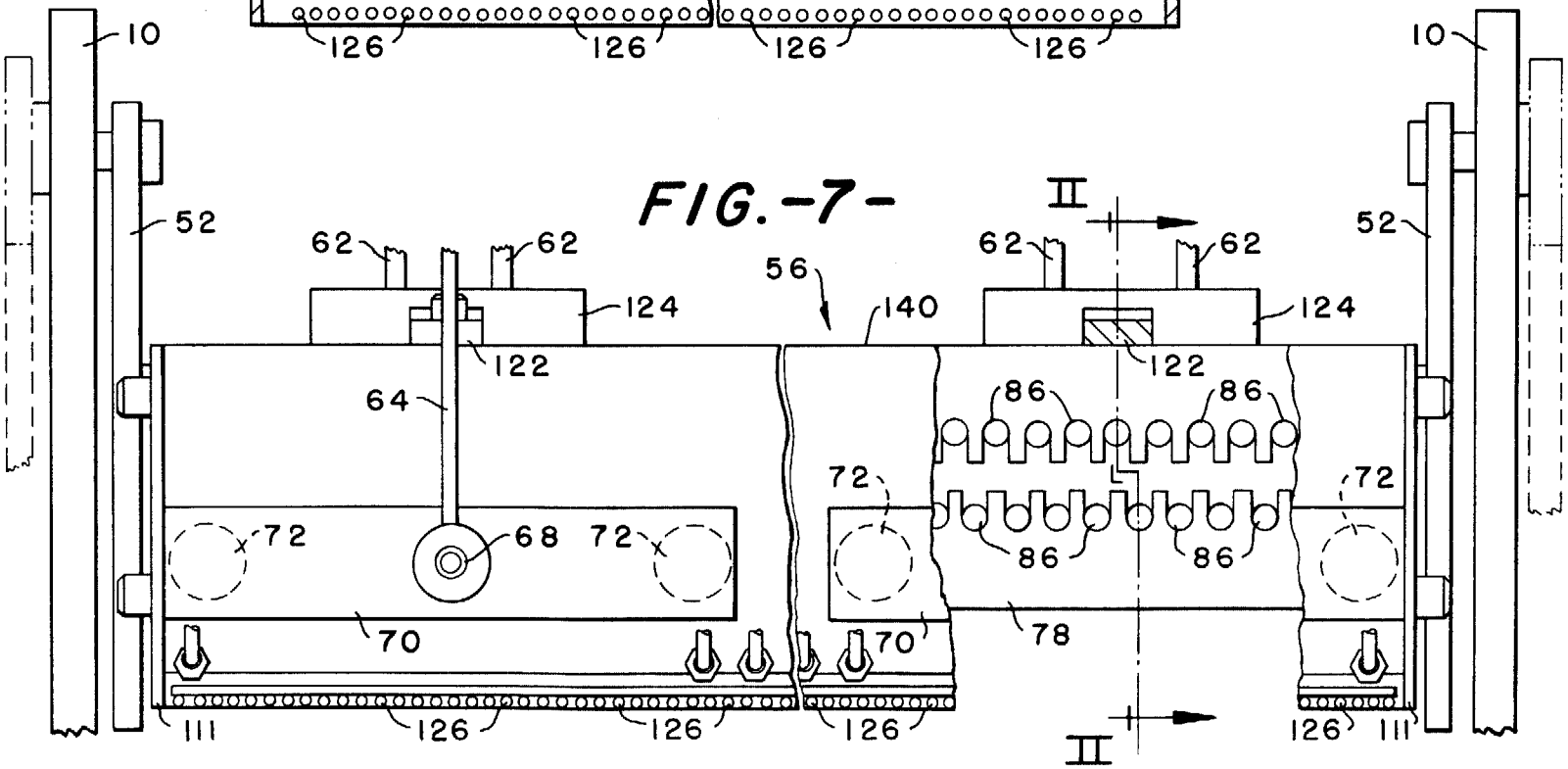
FIG. 7 is an enlarged plan view of end portions of the manifold assembly, taken generally along line VII—VII of FIG. 2 and looking in the direction of the arrows.

As illustrated in FIG. 1 and in FIG. 7, the elongate manifold assembly 30 and the bank of heaters 44 are supported at their ends on the end frame support members 10 of the main support frame by support arms 52 which are pivotally attached to end members 10 to permit movement of the assembly 30 and heaters 44 away from the surface of the fabric 12 and fabric supporting roller 26 during periods when the movement of the fabric through the treating apparatus may be stopped.

Figure 2:
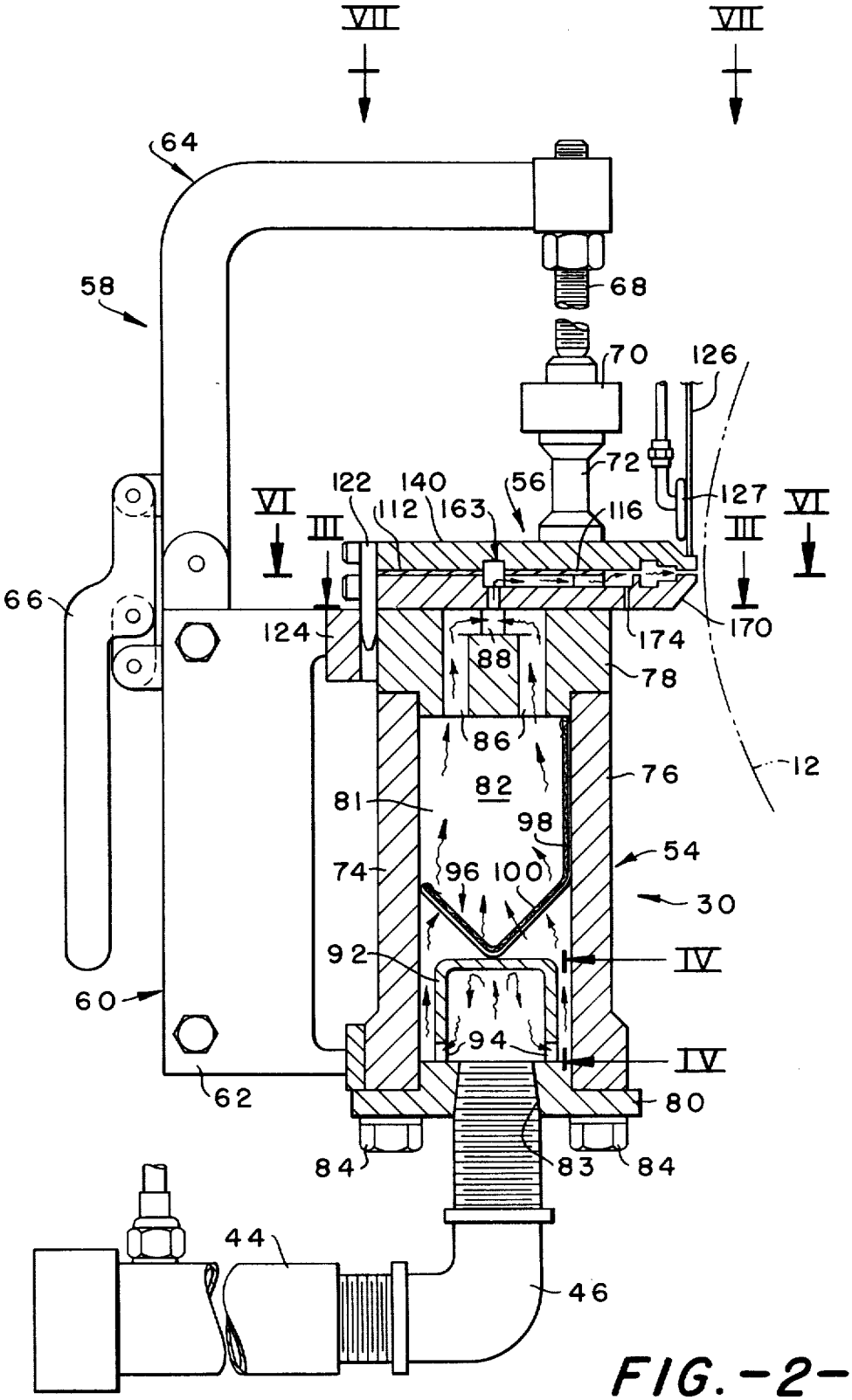
FIG. 2 is an enlarged partial sectional elevation view of the fluid distributing manifold assembly of the apparatus of FIG. 1, taken along a section line of the manifold assembly indicated by the line II—II in FIG. 7.

Details of the improved heated fluid distributing manifold assembly of the present invention may be best described by reference to FIGS. 2–8 of the drawings. As seen in FIG. 2, which is a partial sectional elevation view through the assembly, taken along line II—II of FIG. 7, the manifold assembly 30 comprises a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the fabric 12 adjacent its path of movement. Clamping means 58 comprises a plurality of manually-operated clamps 60 spaced along the length of the housings. Each clamp includes a first portion 62 fixedly attached, as by welding, to the first manifold housing 54, and a second movable portion 64 pivotally attached to fixed portion 62 by a manually operated handle and linkage mechanism 66. Second portion 64 of clamp 60 includes an adjustable threaded screw and bolt assembly 68 with elongate presser bars 70 which apply pressure to manifold housing 56 through a plurality of spacer blocks 72 which are attached to the surface of housing 56 at spaced locations along its length (FIG. 7).

As best seen in FIG. 2, first elongate manifold housing 54 is of generally rectangular cross-sectional shape, and includes a pair of spaced plates forming side walls 74, 76 which extend across the full width of the path of fabric movement, and elongate top and bottom wall plates 78, 80 which define a first elongate fluid receiving compartment 81, the ends of which are sealed by end wall plates 82 suitably bolted thereto. Communicating with bottom wall plate 80 through fluid inlet openings 83 (FIG. 4) spaced uniformly therealong are the air supply lines 46 from each of the electrical heaters 44. The side walls 74, 76 of the housing are connected to top wall plate 78 in suitable manner, as by welding, and the bottom wall plate 80 is removably attached to side walls 74, 76 by bolts 84 to permit access to the fluid receiving compartment. The plates and walls of the housing 54 are formed of suitable high strength material, such as stainless steel, or the like.

The manifold housings 54, 56 are constructed and arranged so that the flow path of fluid through the first housing 54 is generally at a right angle to the discharge axes of the fluid stream outlets of the second manifold housing 56. In addition, the mass comprising side walls 74, 76 and top and bottom wall plates 78, 80 of first manifold housing 54 is substantially symmetrically arranged on opposing sides of a plane bisecting the first fluid receiving compartment 81 in a direction parallel to the elongate length of manifold housing 54 and parallel to the predominant direction of fluid flow, i.e., from inlet openings 83 to passageways 86, through the housing compartment 81. Because the mass of the first housing 54 is arranged in a generally symmetrical fashion with respect to the path of the heated fluid through the housing compartment 81, thermal gradients and the resulting thermally-induced distortions in the first housing 54 also tend to be similarly symmetrical. As a consequence, any distortion of the manifold assembly caused by expansion and contraction due to temperature differentials tends to be resolved in a plane generally parallel to the surface of the textile fabric 12 being contacted by the heated fluid streams. This resolution of movement of the manifold assembly minimizes any displacement of the manifold discharge outlet channels 115 (FIG. 5) toward or away from the fabric 12 as a result of non-uniform thermal expansion of the manifold assembly. Any remaining unresolved thermally-induced displacement of the manifold housing 54 may be corrected by use of jacking members or other means to supply corrective forces directly to the manifold housing.

Figure 3:
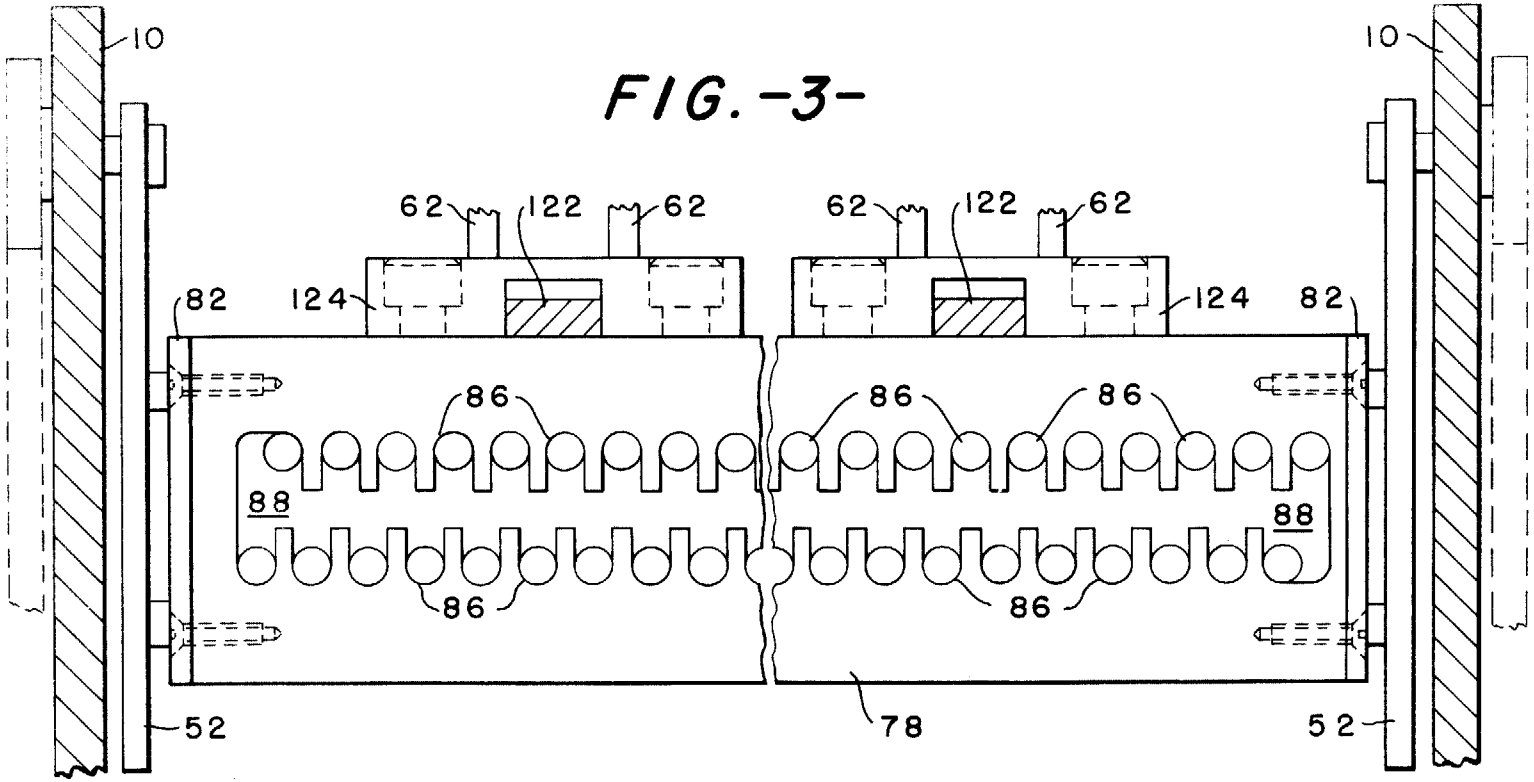
FIG. 3 is an enlarged sectional view of end portions of the elongate manifold assembly, taken generally along line III—III of FIG. 2 and looking in the direction of the arrows.

As best seen in FIGS. 2, 3 and 7, upper wall plate 78 of manifold housing 54 is of relatively thick construction and is provided with a plurality of fluid flow passageways 86 which are disposed in uniformly spaced relation along the plate in two rows to communicate the first fluid receiving compartment 81 with a central elongate channel 88 in the outer face of plate 78 which extends between the passageways along the length of the plate. As seen in FIGS. 3 and 7, the passageways in one row are located in staggered, spaced relation to the passageways in the other row to provide for uniform distribution of pressurized air into the central channel 88 while minimizing strength loss of the elongate plate 78 in the overall manifold assembly.

Figure 4:
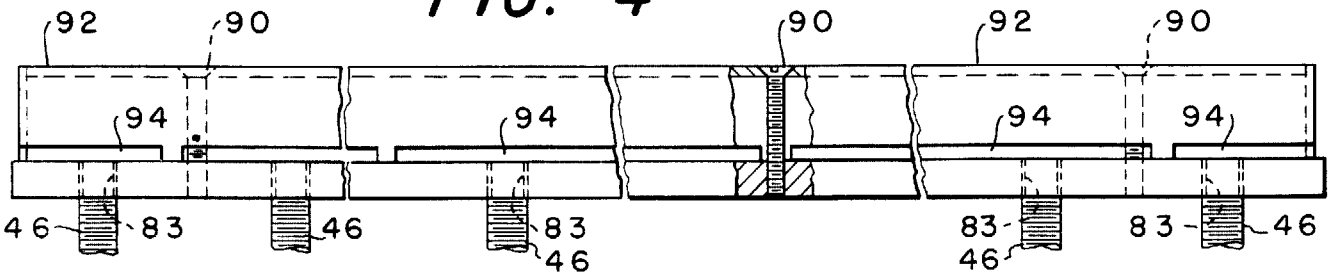
FIG. 4 is an enlarged side elevation view of end portions of the elongate baffle member of the manifold assembly, looking in the direction of arrows IV—IV of FIG. 2.

As seen in FIGS. 2 and 4, located in first fluid receiving compartment 81 and attached to the bottom wall plate 80 of the housing 54 by threaded bolts 90 is an elongate channel-shaped baffle plate 92 which extends along the length of the compartment 81 in overlying relation to wall plate 80 and the spaced, fluid inlet openings 83. Baffle plate 92 serves to define a fluid receiving chamber in the compartment 81 having side openings or slots 94 adjacent wall plate 80 to direct the incoming heated air from the bank of heaters in a generally reversing path of flow through compartment 81. As seen in FIG. 2, disposed above channel-shaped baffle plate 92 in compartment 81 between the fluid inlet openings 83 and fluid outlet passageways 86 is an elongate filter member 96 which consists of a perforated, generally J-shaped plate 98 with filter screen 100 disposed there-about. Filter member 96 extends the length of the first fluid receiving compartment 81 and serves to filter foreign particles from the heated pressurized air during its passage therethrough. Access to the compartment 81 by way of removable bottom wall plate 80 permits periodic cleaning and/or replacement of the filter member, and the filter member is maintained in position in the compartment 81 by frictional engagement with the side walls 74, 76 to permit its quick removal from and replacement in the compartment 81.

As best shown in FIGS. 2 and 5, second smaller manifold housing 56 comprises first and second opposed elongate wall members 140 and 170. When disposed as shown, in spaced, coextensive, parallel relation, members 140 and 170 form a second fluid receiving compartment, shown generally at 160, which serves to divert the air at a right angle, and further serves to form the air into a long, relatively thin blade, which extends the full width of wall members 140, 170, and which is uniform with respect to temperature, pressure, and velocity. Streams of relatively cool air from tubes 126 uniformly arranged along the front-most portion of wall member 140 may be used to block the uniform blade of air over discrete intervals at one or more locations along the length of discharge slot 115 formed by the forward interior portions of wall members 140, 170. In this way, the lateral configuration of the blade of air striking the substrate can be controlled, and pattern information may be imparted to the substrate surface, i.e., the blade of air originating within compartment 160 may be reduced to one or more discrete, narrow streams of air.

Figure 8:
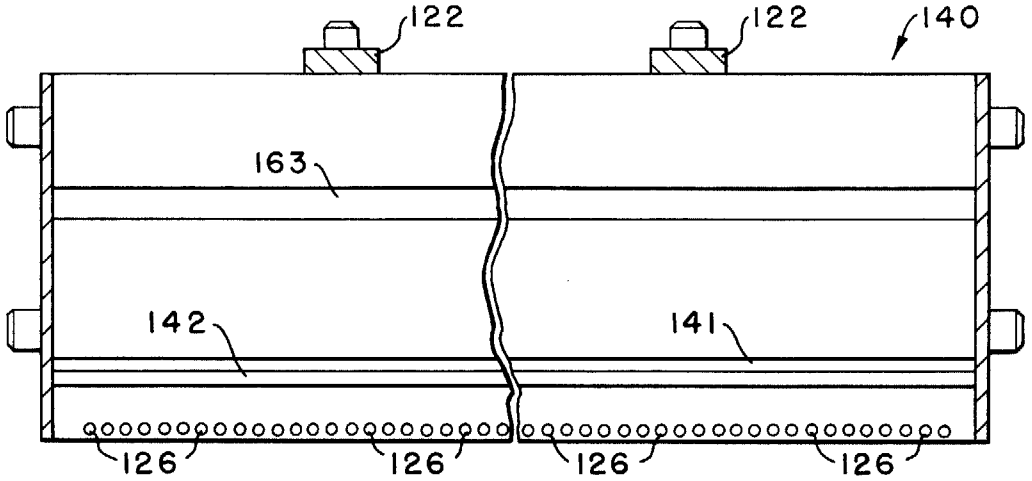
FIG. 8 is an enlarged, schematicized plan view of end portions of the fluid distributing manifold housing from that shown looking in the direction of arrows VIII—VIII of FIG. 5.

FIGS. 5, 6, and 8 disclose the details of second fluid receiving compartment 160, the ends of which are closed by end plates 111 (FIG. 7). Compartment 160 may be thought of as two chambers 162, 166 in serial arrangement, each compartment extending the length of manifold housing 56, and each chamber being followed by a throttling orifice comprising a relatively thin slot 168, 115 of individually uniform gap width extending the length of compartment 160. Heated air which has been mixed in first manifold compartment 81 enters second fluid receiving compartment 160 at a pressure of 1 to 5 p.s.i.g. by way of a plurality of individual fluid inlets 118 which communicate with elongate channel 88 of the first manifold housing 54 along its length. Gallery 163 within chamber 162 serves to mix the air from individual inlets 118, whereupon the air flows into the remaining portion of chamber 162. In this latter portion of chamber 162, the air is made to flow the length of the chamber, thereby mixing with air already present in the chamber. Support partitions 164 act as load bearing and separating members between wall members 140 and 170. As can be seen in FIG. 6, partitions 164 have straight sides, and are tapered (included angle approximately 14°) to a point having a radius of approximately 0.01 inch. This is done primarily to avoid causing turbulence in the fluid flow path within this portion of chamber 162. It is foreseen that other turbulence-minimizing configurations for support partitions 164 are possible.

At the forward end of chamber 162, ridge 165 is used to define slot 168, which acts as a throttling orifice between chamber 162 and adjoining chamber 166. By passing through slot 168, which forms a gap of a uniform width extending the length of wall members 140, 170, a reduction in fluid pressure is effected which allows chamber 166 to act as an expansion chamber. By expanding, the fluid in chamber 166 tends to become completely uniform with respect to temperature, velocity, and pressure. Chamber 166 can be thought of as the reservoir from which air is formed into a blade-like exit stream via discharge slot 115. Discharge slot 115 is formed from opposing flat surfaces on the forward portion of wall members 140, 170, and is also of some uniform gap width all along the lenght of members 140, 170. Where a slot gap width of 0.015 inch is used, a discharge slot depth of 0.38 inch has been found advantageous. Wall segments 141, 142 and 171, 172 merely serve to define a transition area between chamber 166 and discharge slot 115 which does not generate substantial entrance effects. In this regard, it should be noted that rough edges within chamber 166 should be avoided. It is believed that a single cavity having a square cross-section would perform satisfactorily as well. It is suggested, however, that regardless of the cavity cross-sectional shape, the ration of cavity height (dimension "A" in FIG. 5) to slot gap width (slot 168) should be on the order of 10 or more, and preferably 14 or 16 or more. It is foreseeable that other configurations, such as forming the walls of chamber 166 in an appropriate curve, would further minimize entrance effects, but such curves are generally expensive to machine, and have been found to be unnecessary in this embodiment in most applications. It is estimated that the overall effect of slot 168, expansion chamber 166, and discharge slot 115, is to introduce a dynamic head loss on the order of 4.0 with respect to air in compartment 162. It has been found that dynamic head losses of at least 3.0 are most suited to generating the uniform flow desired. Dynamic head losses of about 4.0 or more are recommended for most purposes, as this amount of dynamic head loss is usually sufficient to assure a practically uniform fluid stream emerging from discharge outlet 115.

It should be noted that, due to the design of elongate wall members 140 and 170, machining of said wall members is relatively simple. The load bearing surfaces of wall members 140, 170 may be smoothly machined in a single operation to ensure a fluid tight seal for compartments 162, 166. The inside surface of wall member 140 may be machined by merely cutting into this smoothly machined surface a channel corresponding to the upper portion of gallery 163, and two adjoining channels corresponding to the upper portion of chamber 166. The upper wall portion of discharge slot 115, the upper wall portion of slot 168, and the upper load bearing surfaces above chamber 162 and to the rear of gallery 163 all lie in the same plane. Similarly, those portions of wall portion 170 defining the lower load bearing surfaces to the rear of gallery 163, the load bearing surfaces atop support partitions 164, the upper surface of ridge 165 defining slot 168, and the lower wall portion of discharge slot 115 are all co-planar. It is believed the exact dimensional relationship which this design imposes is not important to the operation of the manifold compartment 160. Thus, for example, it is foreseen that throttling slot 168 need not have the same exact gap size as discharge slot 115.

In addition to simplifying greatly the fabrication of wall members 140 and 170, this design also allows the gap width of discharge slot 115 as well as the gap width of slot 168, to be set merely by inserting flat, rectangular spacer shims 112, 116 of equal thickness between the mating wall members 140, 170, as shown in FIG. 5. This allows for simple, quick adjustment of the gap size of discharge slot 115 in response to requirements imposed by changes in substrate material or visual effect desired. It is foreseen that shim thicknesses of 0.005 inch or less to 0.035 inch or more may be used. The depth of discharge slot 115 may require adjustment at extreme gap widths in order to prevent turbulence within the slot.

As shown in FIGS. 2 and 5, the forward portion of wall member 170 carries vents 174 which allow a small quantity of heated air to be bled from chamber 162, thereby assuring a small but steady flow of fluid through chamber 162. Such flow not only prevents the build-up of stagnant, heated fluid within chamber 162, thereby causing uneven temperature distribution within compartment 160, but also assists in preventing excessive heat build-up in the vicinity of the heater elements 44 and premature heater burn-out. An additional advantage is that the passage of the heated bleed air through vents 174 in lower wall member 170 serves to maintain temperature in the forward section wall member 170 which is subject to cooling via impingement of cool air from cool air vents 126 discussed in more detail below, extending through the forward portion of upper wall member 140.

Lower wall member 170 of the second manifold housing 56 is provided with a plurality of fluid inlet openings 118 which communicate with the elongate channel 88 of the first manifold housing 54 along its length to receive pressurized heated air from the first manifold housing 54 into the second fluid receiving compartment 160. Wall members 140, 170 of the second manifold housing 56 are maintained in fluid tight relation with spacing shim members 112, 116 and with the elongate channel 88 of the first manifold housing 54 by the adjustable clamps 60. Because of the cantilevered design of housing 56, it is advantageous to align clamps 60 with the forward portion of support partitions 164. Guide means, comprising a plurality of short guide bars 122 attached to the second manifold housing 56 and received in guide bar openings in brackets 124 attached to the first manifold housing 54, ensure proper alignment of the first and second manifold housings during their attachment by the quick-release clamps 60.

As seen in FIGS. 1, 2, 5 and 7 of the drawings, discharge slot 115 of the second manifold housing 56 is provided with a plurality of tubes 126, uniformly spaced along the forward portion of wall member 140, which communicate at a right angle to the axis of discharge slot 115 to introduce pressurized cool air, i.e., air having a pressure of approximately 10–20 p.s.i.g. and a temperature substantially below that of the heated air in chamber 166, into discharge slot 115 to selectively block the flow of heated air at selected points or intervals along the width of slot 115 in accordance with pattern control information. Air passing through the tubes 126 may be cooled by a water jacket 127. As seen in FIG. 1, pressurized unheated air is supplied to each of the tubes 126 from compressor 38 by way of a master control valve 128, pressure regulator valve 129, air line 130, and unheated air header pipe 132 which is connected by a plurality of individual air supply lines 134 to the individual tubes 126. Each of the individual cool air supply lines 134 is provided with an individual control valve located in a valve box 136. These individual control valves are operated to open or close in response to signals from a pattern control device, such as a computer 138, to stop the flow of hot air at selected points along the width of slot 115 during movement of the fabric and thereby produce a desired pattern in the fabric. Detailed patterning information for individual patterns may be stored and accessed by means of any known data storage medium suitable for use with electronic computers, such as magnetic tape, EPROMs, etc.

That which I claim is:

1. An apparatus for pressurized heated fluid stream treatment of a relatively moving substrate material to impart a change in the appearance thereof, comprising an elongate fluid distributing manifold assembly disposed across the path of relative movement of the material and closely adjacent the surface thereof for discharging at least one uniform stream of heated pressurized fluid against the surface of the material, said manifold assembly comprising:

first and second elongate manifold housings defining corresponding first and second fluid-receiving compartments extending across the path of relative movement of the material;

said first housing including inlet'means for introducing pressurized heated fluid into said first compartment generally uniformly along its elongate length, outlet means located remotely from said inlet means for discharging heated fluid from the compartment generally uniformly along its elongate length, said first housing inlet and outlet means defining a flow path through said housing which is generally perpendicular to its length;

said second manifold housing including inlet means for receiving pressurized heated fluid into said second compartment generally uniformly along its length, fluid stream discharge outlet means in said second housing for directing uniformly at least one stream of fluid against the surface of the substrate material, said second housing inlet and outlet means defining a flow path of heated fluid through said housing which is generally perpendicular to its length, said flow path within said second manifold including a plurality of chambers in serial arrangement, one of said plurality of chambers including a plurality of support partitions positioned within said flow path, each of said chambers being followed by a throttling means, at least one of said throttling means allowing said fluid flowing past said partitions to expand and become more uniformly distributed along the length of said second housing, thereby promoting uniform treatment of said substrate by said fluid; and means attaching said second housing to said first housing, with said outlet means of said first housing communicating with said inlet means of said second housing, and with the axis of discharge of said fluid stream discharge outlet means disposed at a substantially right angle to the heated fluid flow path through said first manifold housing.

2. Apparatus of claim 1 wherein said second manifold housing further includes pattern control means and means for directing a plurality of pressurized streams of relatively cool fluid at spaced locations across said fluid stream discharge outlet to block the flow of said pressurized, heated fluid from said second compartment at selected of said spaced locations along the length of said discharge outlet in response to patterning information supplied by said pattern control means.

3. Apparatus of claim 1 wherein said flow path within said second compartment comprises a first chamber and associated throttling means, followed in serial arrangement by a second chamber and associated throttling means which in turn is followed by said fluid stream discharge outlet means, and wherein a segment of said flow path beginning immediately before said first throttling means and ending immediately after said second throttling means provides a dynamic head loss greater than 3.0.

* * * * *

UNITED STATES PATENT AND TRADEMARK OFFICE

CERTIFICATE OF CORRECTION

PATENT NO. : 4,471,514

DATED : September 18, 1984

INVENTOR(S) : Jimmy L. Stokes

It is certified that error appears in the above-identified patent and that said Letters Patent is hereby corrected as shown below:

Column 8, line 7, the word "lenght" should be "length"

Column 8, line 18, the word "ration" should be "ratio".

Signed and Sealed this

*Fifth* Day of *March 1985*

[SEAL]

*Attest:*

DONALD J. QUIGG

*Attesting Officer* *Acting Commissioner of Patents and Trademarks*